US007531063B2

(12) United States Patent
Döling

(10) Patent No.: US 7,531,063 B2
(45) Date of Patent: May 12, 2009

(54) METHOD AND APPARATUS FOR HEATING A ROLLER

(75) Inventor: Fabian Döling, Meerbusch (DE)

(73) Assignee: Voith Patent GmbH, Heidenheim (DE)

( * ) Notice: Subject to any disclaimer, the term of this patent is extended or adjusted under 35 U.S.C. 154(b) by 410 days.

(21) Appl. No.: 10/583,733

(22) PCT Filed: Jan. 21, 2005

(86) PCT No.: PCT/EP2005/050258

§ 371 (c)(1),
(2), (4) Date: Jun. 20, 2006

(87) PCT Pub. No.: WO2005/078186

PCT Pub. Date: Aug. 25, 2005

(65) Prior Publication Data

US 2008/0257510 A1 Oct. 23, 2008

(30) Foreign Application Priority Data

Feb. 10, 2004 (DE) ..... 10 2004 006 515

(51) Int. Cl.
*D21G 1/02* (2006.01)

(52) U.S. Cl. ..... 162/199; 162/207; 162/252; 162/272; 162/375; 492/46

(58) Field of Classification Search ..... 162/199, 162/272, 198, 263, 290, 375, 361, 359.1, 162/252, 206, 207; 492/20, 46
See application file for complete search history.

(56) References Cited

U.S. PATENT DOCUMENTS 4,324,613 A * 4/1982 Wahren ..... 162/111
4,691,449 A 9/1987 Wiberg
4,722,681 A 2/1988 Smith
4,774,747 A 10/1988 Kurschatke
5,009,592 A 4/1991 Roldan et al.
5,240,564 A * 8/1993 Niskanen et al. ..... 162/358.1
5,416,979 A 5/1995 Joiner
5,465,504 A 11/1995 Joiner
5,810,577 A * 9/1998 Ledjeff ..... 431/170
5,937,538 A 8/1999 Joiner

FOREIGN PATENT DOCUMENTS

DE 35 09 104 9/1986
DE 37 12 203 9/1988

(Continued)

OTHER PUBLICATIONS

German Search Report 10 2004 006.

(Continued)

*Primary Examiner*—Eric Hug
(74) *Attorney, Agent, or Firm*—Hershkovitz & Associates, LLC; Abraham Hershkovitz

(57) ABSTRACT

A method and an apparatus for heating a roller used in the production and/or finishing of a web of material, particularly a paper web or paperboard web, are provided. According to the method, a roller is heated from the outside by a heated gas. The apparatus is configured to heat a roller used in the production and/or finishing of a web of material according to the method.

47 Claims, 3 Drawing Sheets

FOREIGN PATENT DOCUMENTS

| | | |
|---|---|---|
| DE | G 90 15 548.9 | 4/1991 |
| DE | 41 01 354 | 7/1992 |
| DE | 689 01 963 | 7/1992 |
| DE | 297 00 869 | 7/1997 |
| DE | 699 06 573 | 4/2000 |
| EP | 0285885 | 10/1988 |
| EP | 1 133 599 | 4/2000 |

OTHER PUBLICATIONS

PCT/EP2005/050258 Search Report.
PCT/EP2005/050258 Written Opinion.

* cited by examiner

METHOD AND APPARATUS FOR HEATING A ROLLER

CROSS REFERENCE TO RELATED APPLICATIONS

The present application is the National Stage Application of International Application No. PCT/EP2005/050258, filed Jan. 21, 2005, which claims priority to DE 10 2004 006 515.2, filed on Feb. 10, 2004.

BACKGROUND OF THE INVENTION

The present invention relates to a method and apparatus for heating a roller used in the production and/or finishing of a web, particularly a paper web or paperboard web.

The present invention creates an improved method and apparatus by use of renewable fuels.

In various embodiments, the roller is heated from the outside by a heated gas. The heated gas can be generated by at least one burner arranged near a surface of the roller. The heated gas emerging from the burner can then act on the surface of the rotating roller.

Hence, the heat is generated near the location of the roller. Furthermore, renewable fuels can be used to generate required heat.

SUMMARY OF THE INVENTION

According to various embodiments of the present invention, axial heat zones can be used to achieve distinct axial temperatures along the roller. The distinct axial temperatures can be transferred to the web during production and/or finishing.

For example, several burners can be distributed over the length of the roller.

According to various embodiments of the present invention, the burner used is a catalytic burner by which the heated gas is generated through combustion of a fuel with air or oxygen.

A burner can thus comprise, for example, a carrier with a catalytic coating.

The fuel used can be a fuel gas. Hence the burner can be fed, for example, with an adjustable fuel gas/air mixture. In this case, preferably fuel and air are fed to a mixing element upstream from the respective burner.

In one exemplary embodiment, supplied air is distributed by an air distributor among several burners.

The reaction or roller temperature can be set or controlled by the fuel/air mass flow ratio.

For example, the fuel gas mass flow and/or the fuel gas concentration in the air can be controlled for each axial heat zone.

In an exemplary embodiment, the fuel used can be hydrogen, hydrogen-rich gas (reformat) or natural gas.

According to another embodiment of the invention, a respective burner is arranged in an air-moving chamber and the air flowing over the burner is mixed with the burner waste gas. In this case the air flowing over the burner can be expediently mixed with the waste gas from the burner by a mixing element. The mixing element may be located near a terminus of the air moving chamber. The terminus of the air moving chamber may be adjacent the roller.

In this case the air flowing over the burner can be heated by the burner. In another exemplary embodiment, the burner may work adiabatically, meaning that there is no transfer of heat to the "bypass flow". The cold bypass flow is then mixed with the hot burner waste gas, resulting downstream from the mixing element in a mixture with a desired temperature.

Such an embodiment may be advantageous when using a fuel that reacts with air only at high temperatures. Natural gas, for example, does not react fully with air until it reaches a higher temperature range of 600° C.-800° C.

The hot gas temperatures may be too high for the roller surface. Therefore, the hot gas is mixed with the "cold" bypass flow.

According to another embodiment of the present invention, heated gas generated by the burner is mixed with supplied cold air in at least one mixing element. In this case it is advantageous for the mass flow of the cold air supplied to the mixing element to be adjustable or controllable. Again, the burner is preferably supplied with air and fuel, particularly fuel gas. The fuel gas can be natural gas.

In one exemplary embodiment, heated gas generated by the burner can be distributed by a gas distributor among several mixing elements that are arranged over the length of the roller. The mass flows of cold air supplied to the various mixing elements can be individually adjustable or controllable.

As stated previously, axial heat zones may be used to achieve distinct axial temperatures along the roller.

According to one aspect of the invention, a method for heating a roller is provided, the method including: heating a first gas in a first axial zone; directing the first gas toward the roller to achieve a first surface temperature; heating a second gas in a second axial zone; and directing the second gas toward the roller to achieve a second surface temperature, wherein the first axial zone and the second axial zone are located exterior to the roller and along distinct axial locations adjacent the roller. The first gas can be produced by a fuel supplied to a burner. The first surface temperature can be distinct from the second surface temperature. The method can include heating a third gas in a third axial zone; and directing the third gas toward the roller to achieve a third surface temperature. The burner can include one of a catalytic burner or a carrier having a catalytic coating. The fuel can be a fuel gas. The fuel gas to air ratio can be adjustable. The fuel gas and air can enter a mixing element prior to entering the burner. An air distributor can supply air for at least the first and second axial zones. The fuel gas can have a variable mass flow rate. The fuel gas can include one of hydrogen or natural gas. The first gas can include an output from the burner and burner waste gas. The output from the burner can be combined in a mixing element with the burner waste gas. The first gas can be mixed in a mixing element with a first air input to produce a first heat gas. The first air input can be variable. The gas distributor can direct the first heat gas through a first axial mixing element.

According to another aspect of the invention, an apparatus for heating a roller is provided, the apparatus including: a first axial zone for heating a first gas; a first exit zone defining a portion of the first axial zone; a second axial zone for heating a second gas; and a second exit zone defining a portion of the second axial zone, wherein the first and second exit zones are located exterior to the roller and define distinct axial locations along the roller. The apparatus can further include a first burner for producing the first gas, whereby fuel is input to the first burner. The apparatus can further include at least one of an adjustable fuel to air ratio, a mixing element for the fuel and air, and an air distributor for supplying air to the burner.

BRIEF DESCRIPTION OF THE DRAWINGS

The present invention will be described in more detail in the following text using exemplary embodiments and with reference to the drawing, in which.

DETAILED DESCRIPTION OF THE PREFERRED EMBODIMENT

Figure 1:
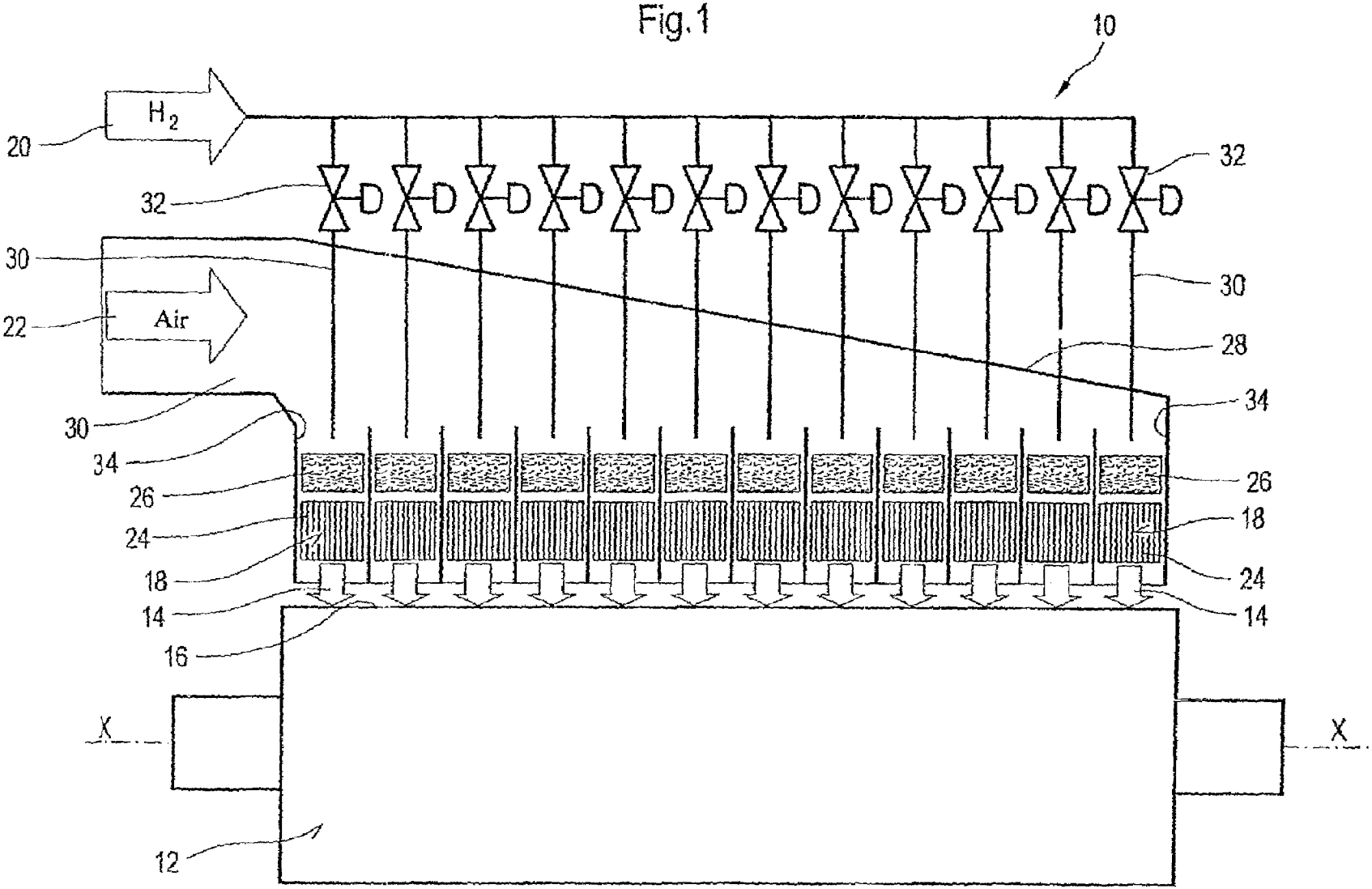
FIG. 1 illustrates one exemplary embodiment of a device for heating a roller with several catalytic burners that are arranged in succession in the direction of the roller axis.

FIG. 1 illustrates an embodiment of a device 10 for heating a roller 12 for producing and/or finishing a web of material, particularly a paper web or paperboard web.

The roller 12 can be heated from the outside by the device 10 using a heated gas 14. For this purpose the device 10 comprises several burners 18 which are distributed over the length of the roller 12 and arranged near the roller surface 16.

The heated gas 14 emerging from the burners 18 acts on the surface 16 of the roller 12.

According to an exemplary embodiment, the roller 12 is heatable on a zone basis in the direction of the roller axis, thus enabling differentiation in the transverse direction of the web, meaning transverse to the running direction of the web. Axial heat zones can be used to achieve distinct axial temperatures along the roller 12. The distinct axial temperatures can be transferred to the web during production and/or finishing.

According to an exemplary embodiment, the burners 18 are catalytic burners for heating the gas 14 generated through combustion of a fuel 20 with air 22 or oxygen.

Hence the burners 18 can each comprise a carrier 24 with a catalytic coating.

The fuel 20 provided can be for example, hydrogen ($H_2$) or hydrogen-rich gas (reformat). Other fuels can also be used within the scope of the present invention.

An adjustable fuel gas/air mixture is fed in each case to the various catalytic burners 18. In this case a mixing element 26, to which fuel 20 and air 22 are fed, is installed upstream from the burners 18.

In one exemplary embodiment, an air distributor 28 distributes supplied air 22 among the various catalytic burners 18.

In one exemplary embodiment, the roller temperature is adjustable or controllable within axial zones by adjusting individual fuel/air mass flow ratios. Provisions can be made, for example, for controlling the respective fuel gas mass flow and/or the respective fuel gas concentration in the air.

The control or adjustment can be performed within axial zones. In the present exemplary embodiment, control valves 32 are provided for this purpose in the various fuel supply lines 30 to the various mixing elements 26.

The various catalytic burners 18 are arranged in a chamber 34 in which provision is also made for the mixing element 26 installed upstream from the burner 18. Using chamber 34, heating gas 14 can be made to yield distinct temperature zones on the roller 12.

Figure 2:
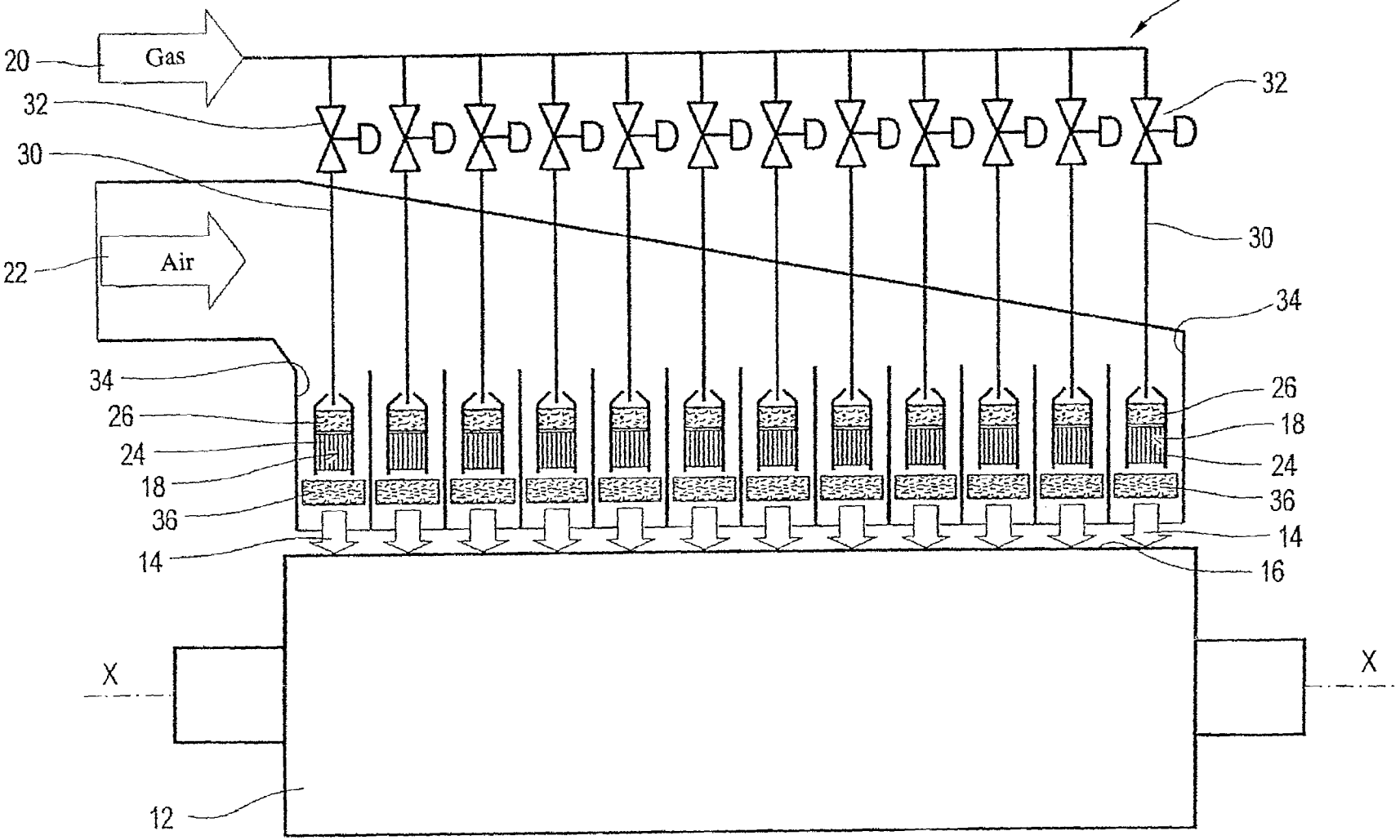
FIG. 2 illustrates another embodiment of the heating device in which the catalytic burners are arranged in each axial heat zone in an air-moving chamber and the air heated by a respective burner is used to generate the heated gas which acts on the roller.

Another exemplary embodiment of the heating device 10 presented in FIG. 2 differs from FIG. 1 in that the various catalytic burners 18 are arranged respectively in an air-moving chamber 34. The air flowing over the burners 18 for generating the heated gas 14 for acting on the roller 12 is mixed with the burner waste gas.

In this case the air flowing over the burner 18 can be heated by the burner 18. It is also conceivable, however, for the burner to work adiabatically, meaning that there is no transfer of heat to the "bypass flow". The cold bypass flow is then mixed with the hot burner waste gas, resulting downstream from the mixing element in a mixture with a desired temperature. Such an embodiment is beneficial when using a fuel that reacts with air only at high temperatures. Natural gas, for example, does not react fully with air until it reaches a temperature range 600° C.-800° C. The hot gas temperatures may be too high for the roller surface. Therefore, the hot gas is mixed with the "cold" bypass flow.

According to this exemplary embodiment, the mixing element 36 can be located near a terminus of the air moving chamber 34, whereby the terminus of the air moving chamber 34 is adjacent roller 12. Air flowing over and heated by the catalytic burner 18 is mixed with the waste gas from the burner 18. The heated air emerging from the mixing elements 36 then acts on the roller 12.

Again, a mixing element 26 is installed respectively upstream from the catalytic burners 18 in order to generate the mixture of fuel and air supplied to the respective burner 18.

According to one exemplary embodiment, natural gas can be provided as fuel 20.

Temperature differentiation across the web width is possible according to the present exemplary embodiment.

Figure 3:
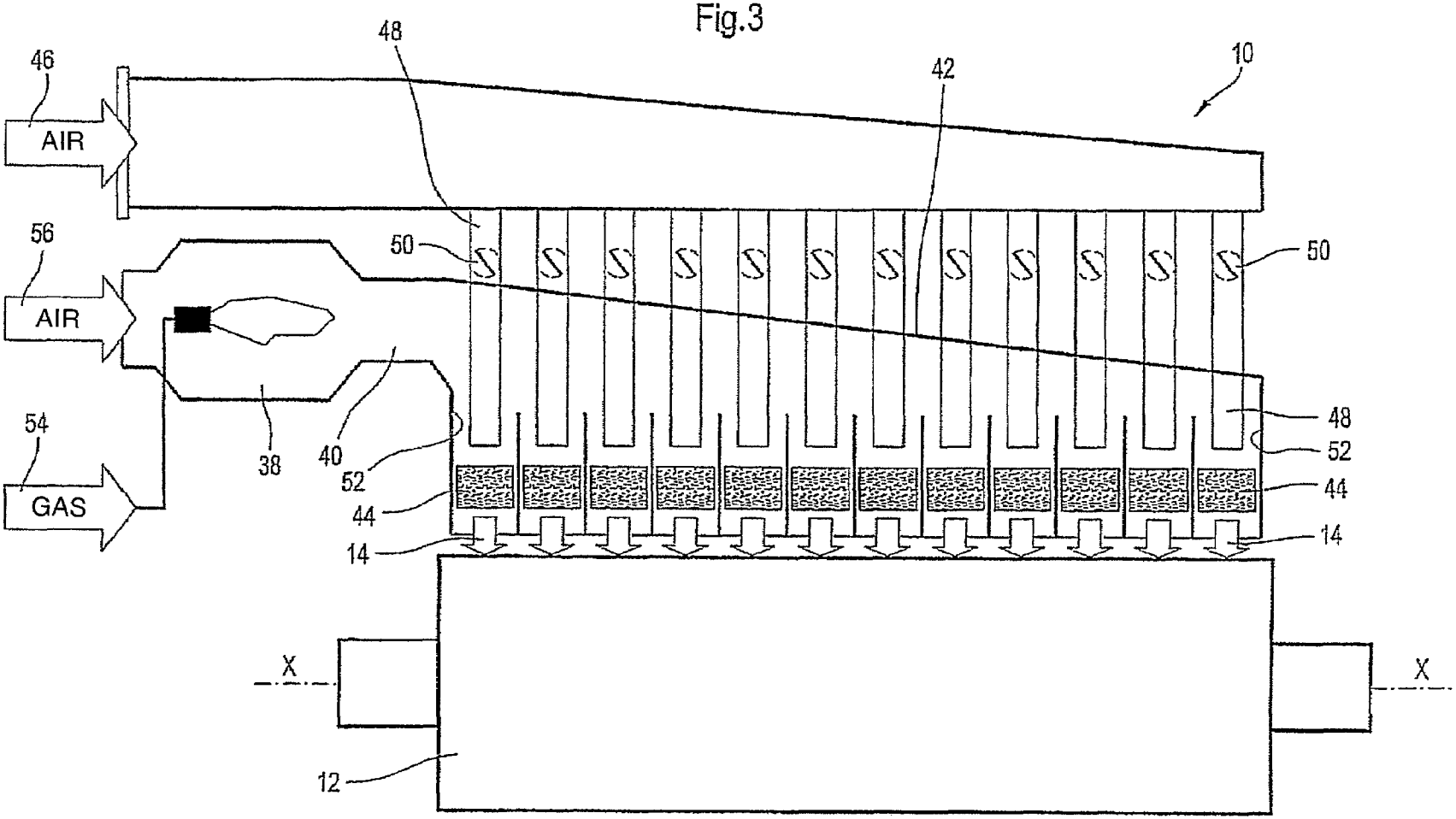
FIG. 3 illustrates another embodiment in which the heated gas generated by a gas burner is distributed by a gas distributor among several mixing elements, located over the axial length of the roller, and fed with cold air, whereby the mass flows of cold air supplied to the various mixing elements are individually adjustable or controllable.

FIG. 3 illustrates a further exemplary embodiment of the device 10.

In the present exemplary embodiment, the hot gas 40 generated by a gas burner 38 is distributed by a gas distributor 42 among several mixing elements 44 that are distributed over the length of the roller 12 and each supplied individually with cold air 46. The mass flows of cold air 46 supplied to the various mixing elements 44 are adjustable or controllable for each distinct temperature zone. Throttle valves 50 are provided in the various fuel supply lines 48 to the various mixing elements 44.

The hot gas 40 supplied by the gas burner 38 is mixed with the cold air supplied through the cold air supply line 48 to the mixing elements 44, arranged in a chamber 52, to generate the hot air 14 for acting on the roller 12.

As evident in FIG. 2, a fuel gas 54, in this case natural gas for example, and air 56 are fed to the burner 38.

The mass flows of cold air supplied to the various mixing elements 44 are adjustable or controllable via the throttle valves 50. Temperature differentiation in the transverse direction of the web is also possible.

LIST OF REFERENCE NUMERALS

10 Heating device
12 Roller
14 Heated gas, heat gas
16 Roller surface
18 Catalytic burner
20 Fuel

22 Air
24 Catalytic carrier with catalytic coating
26 Mixing element
28 Air distributor
30 Fuel supply line
32 Chamber
34 Air-moving chamber
36 Mixing element
38 Gas burner
40 Hot gas
42 Gas distributor
44 Mixing element
46 Cold air
48 Cold air supply line
50 Throttle valve
52 Chamber
54 Fuel gas
56 Air
X Roller axis

The invention claimed is:

1. A method for heating a roller used in at least one of a production and finishing of a web of material, comprising heating the roller from the outside by a heated gas mixture, wherein a mixture of fuel and air is fed to at least one mixing element upstream or downstream of at least one burner; and wherein said burner is arranged in an air-moving chamber.

2. The method according to claim 1, wherein a fuel gas is generated by at least one burner arranged near a surface of the roller for the heating of the roller.

3. The method according to claim 2, wherein the fuel gas emerging from the at least one burner acts on the surface of the roller for the heating of the roller.

4. The method according to claim 1, wherein the roller is heatable on a zone basis viewed in a direction of a roller axis, with various zones being heatable independently of each other at least in part for the heating of the roller.

5. The method according to claim 2, wherein several burners are distributed over the length of the roller for the heating of the roller.

6. The method according to claim 2, wherein the at least one burner is a catalytic burner for generating heated gas through combustion of a fuel with one of air or oxygen for the heating of the roller.

7. The method according to claim 2, wherein the at least one burner comprises a carrier with catalytic coating for the heating of the roller.

8. The method according to claim 1, wherein a fuel gas is utilized as fuel for the heating of the roller.

9. The method according to claim 2, wherein the at least one burner is fed with a particular adjustable fuel gas and air mixture for the heating of the roller.

10. The method according to claim 9, wherein the fuel and air are fed to a mixing element installed upstream from the at least one burner for the heating of the roller.

11. The method according to claim 6, wherein a supplied air is distributed by an air distributor among several burners for the heating of the roller.

12. The method according to claim 1, wherein a reaction or roller temperature is one of adjusted or controlled by a fuel and air mass flow ratio for one of adjusting or controlling the heating of the roller.

13. The method according to claim 1, wherein a fuel gas mass flow is controlled for one of adjusting or controlling the heating of the roller.

14. The method according to claim 1, wherein a fuel gas concentration in air is controlled for one of adjusting or controlling the heating of the roller.

15. The method according to claim 1, wherein a respective control is performed on a zone basis for one of adjusting or controlling the heating of the roller.

16. The method according to claim 1, wherein one of hydrogen or hydrogen-rich gas is utilized as fuel for the heating of the roller.

17. The method according to claim 1, wherein natural gas is utilized as fuel for the heating of the roller.

18. The method according to claim 1, wherein air flowing over the burner is mixed with burner waste gas for the heating of the roller.

19. The method according to claim 18, wherein the air flowing over the burner is mixed with the waste gas from the burner by a mixing element in a region of the end of the air-moving chamber facing the roller for the heating of the roller.

20. The method according to claim 1, wherein hot gas generated by a burner is mixed with supplied cold air in at least the one mixing element in order to generate heated gas for acting on the roller for the heating of the roller.

21. The method according to claim 20, wherein the mass flow of the cold air fed to the at least one mixing element is one of adjustable or controllable for one of adjusting or controlling the heating of the roller.

22. The method according to claim 20, wherein the burner is fed with air and fuel for the heating of the roller.

23. The method according to claim 22, wherein the fuel is natural gas for the heating of the roller.

24. The method according to claim 20, wherein hot gas generated by the burner is distributed by a gas distributor among several mixing elements that are distributed over the length of the roller for the heating of the roller.

25. The method according to claim 24, wherein mass flows of cold air fed to the several mixing elements are one of separately adjustable or controllable at least in part, for one of adjusting or controlling the heating of the roller.

26. A method for heating a roller, the method comprising:

heating a first gas in a first axial zone;

directing the first gas toward the roller to achieve a first surface temperature;

heating a second gas in a second axial zone; and directing the second gas toward the roller to achieve a second surface temperature, wherein the first axial zone and the second axial zone are located exterior to the roller and along distinct axial locations adjacent the roller and at least one of the first gas and the second gas is mixed with air in at least one mixing element.

27. The method of claim 26, wherein the first gas is produced by a fuel supplied to a burner.

28. The method of claim 26, wherein the first surface temperature is distinct from the second surface temperature.

29. The method of claim 26 further comprising:

heating a third gas in a third axial zone; and directing the third gas toward the roller to achieve a third surface temperature.

30. The method of claim 27, wherein the burner comprises one of a catalytic burner or a carrier having a catalytic coating.

31. The method of claim 27, wherein the fuel is a fuel gas.

32. The method of claim 31, wherein the fuel gas to air ratio is adjustable.

33. The method of claim 32, wherein the fuel gas and air enter a mixing element prior to entering the burner.

34. The method of claim 32, wherein an air distributor supplies air for at least the first and second axial zones.

35. The method of claim 31, wherein the fuel gas has a variable mass flow rate.

36. The method of claim 31, wherein the fuel gas comprises one of hydrogen or natural gas.

37. The method of claim 27, wherein the first gas comprises output from the burner and burner waste gas.

38. The method of claim 37, wherein the output from the burner is combined in a mixing element with the burner waste gas.

39. The method of claim 27, wherein the first gas is mixed in a mixing element with a first air input to produce a first heat gas.

40. The method of claim 39, wherein the first air input is variable.

41. The method of claim 39, wherein a gas distributor directs the first heat gas through a first axial mixing element.

42. The method of claim 41, wherein the first air input is variable.

43. An apparatus for heating a roller, the apparatus comprising:

a first axial zone for heating a first gas;

a first exit zone defining a portion of the first axial zone;

a second axial zone for heating a second gas;

a second exit zone defining a portion of the second axial zone; and at least one mixing element for at least one of the first gas and the second gas, and air, wherein the first and second exit zones are located exterior to the roller and define distinct axial locations along the roller.

44. The apparatus of claim 43 further comprising:

a first burner for producing the first gas, whereby fuel is input to the first burner.

45. The apparatus of claim 43 further comprising:

an adjustable fuel to air ratio.

46. The apparatus of claim 45 further comprising:

a mixing element for the fuel and air.

47. The apparatus of claim 46 further comprising:

an air distributor for supplying air to the burner.

* * * * *